US005287634A

United States Patent [19]

Hain et al.

[11] Patent Number: 5,287,634

[45] Date of Patent: Feb. 22, 1994

[54] REMOVAL OF VAPORIZABLE COMPONENTS FROM POLYMERIC PRODUCTS

[75] Inventors: Matthew Hain, New Haven; Michael P. Chesterfield, Norwalk, both of Conn.

[73] Assignee: United States Surgical Corporation, Norwalk, Conn.

[21] Appl. No.: 71,333

[22] Filed: Jun. 3, 1993

Related U.S. Application Data

[63] Continuation of Ser. No. 832,791, Feb. 7, 1992, abandoned.

[51] Int. Cl.[5] ..... F26B 5/04

[52] U.S. Cl. ..... 34/16; 34/92; 34/187; 34/68; 606/231; 264/102

[58] Field of Search ..... 34/15, 16, 17, 18, 36, 34/68, 69, 92, 186, 187, 12, 60; 264/344, 101, 102; 606/231, 228

[56] References Cited

U.S. PATENT DOCUMENTS

| | | | |
|---|---|---|---|
| 2,221,351 | 11/1940 | Kempf | 34/187 |
| 2,325,060 | 7/1943 | Ingersoll | 5/115.5 |
| 2,509,741 | 5/1950 | Miles | 57/157 |
| 3,133,138 | 5/1964 | Alexander, Jr. | 264/290 |
| 3,159,964 | 12/1964 | Kretsch | 57/157 |
| 3,161,913 | 12/1964 | Pound | 18/8 |
| 3,225,534 | 12/1965 | Knospe | 57/140 |
| 3,361,728 | 1/1968 | Coen et al. | 260/93.7 |
| 3,387,833 | 6/1968 | Whittaker et al. | 263/3 |
| 3,413,397 | 11/1968 | Bierbaum | 264/290 |
| 3,422,181 | 1/1969 | Chirgwin, Jr. | 260/78.3 |
| 3,432,590 | 3/1969 | Papps | 264/210 |
| 3,460,215 | 8/1969 | Graf | 28/62 |
| 3,471,608 | 10/1969 | Schippers | 264/85 |
| 3,493,646 | 2/1970 | Larkin et al. | 264/290 |
| 3,560,604 | 2/1971 | Papps | 264/168 |
| 3,565,869 | 2/1971 | DeProspero | 260/78.3 |
| 3,626,948 | 12/1971 | Glick et al. | 128/335.5 |
| 3,630,205 | 12/1971 | Listner | 128/335.5 |
| 3,739,056 | 6/1973 | Evans et al. | 264/290 |
| 3,772,420 | 11/1973 | Glick et al. | 264/102 |
| 3,833,708 | 9/1974 | Miller et al. | 264/344 |
| 3,905,076 | 9/1975 | Harris | 28/71.3 |
| 3,978,192 | 8/1976 | Sussman | 264/290 N |
| 4,055,696 | 10/1977 | Kamada et al. | 428/398 |
| 4,160,799 | 7/1979 | Locey et al. | 264/342 R |
| 4,304,048 | 12/1981 | Smith et al. | 34/92 |
| 4,311,660 | 1/1982 | Barham et al. | 264/342 R E |
| 4,455,273 | 6/1984 | Harpell et al. | 264/184 |
| 4,545,135 | 10/1985 | Barriquand et al. | 34/187 |
| 4,769,922 | 9/1988 | Jansson et al. | 34/92 |
| 4,891,872 | 1/1990 | Sussman | 28/244 |
| 4,902,462 | 2/1990 | Bert | 264/103 |
| 4,911,165 | 3/1990 | Lennard et al. | 606/231 |
| 4,940,559 | 7/1990 | Kretschmann et al. | 264/130 |
| 5,007,922 | 4/1991 | Chen et al. | 606/228 |
| 5,051,272 | 9/1991 | Hermes et al. | 427/2 |
| 5,066,439 | 11/1991 | Nishikawa et al. | 264/103 |
| 5,079,854 | 1/1992 | Hammond et al. | 34/187 |

FOREIGN PATENT DOCUMENTS

| | | |
|---|---|---|
| 2436665 | 2/1975 | Fed. Rep. of Germany . |
| 6021213 | 7/1983 | Japan . |

OTHER PUBLICATIONS

Shah Thesis, Oct. 1976.

*Primary Examiner*—Henry A. Bennet
*Assistant Examiner*—Denise Gromada

[57] ABSTRACT

A method and apparatus for removing vaporizable components from polymeric products effects uniform distribution of heat over such products contained within a chamber. The apparatus includes a heated chamber having support means for supporting the products within the chamber. Omnidirectional multi-point gas dispersion means located within the chamber uniformly disperse heated gas over the product. The vaporizable components are evacuated from the chamber along with the gas. The product can be rotated during treatment to ensure uniform exposure of the product to heat and gas.

39 Claims, 5 Drawing Sheets

REMOVAL OF VAPORIZABLE COMPONENTS FROM POLYMERIC PRODUCTS

This is a continuation of copending application Ser. No.07/832,791, filed on Feb. 7, 1992, now abandoned.

BACKGROUND OF THE INVENTION

1. Field of the Invention

The present invention relates to removal of vaporizable components from polymeric products. More particularly, undesirable vaporizable components are removed from biomedical polymeric products.

2. Description of the Related Art

Polymeric compounds are being used to form an increasing array of medical devices including sutures, drug delivery devices, textile-like materials such as bandages, tape and barriers, and other prosthetic devices. Such polymers include polypropylene, polystyrene, polycarbonate, etc. Bioabsorbable polymers are being used with increasing frequency in medicine because they can be implanted to perform a specified function and, when the function is complete, the polymer dissipates thus eliminating the need for further invasive surgical intervention.

Examples of bioabsorbable polymers used in medicine include polylactic acid, polyglycolic acid, polydioxanone, copolymers of glycolide and trimethylene carbonate, polylactide/polyglycolide copolymers, polyesteramides, etc. Polylactide/polyglycolide copolymers are frequently the bioabsorbable copolymers of choice because they retain strength after implantation in the body and slowly degrade into non-toxic breakdown products. Moreover, the copolymer may be molded or extruded into a variety of shapes.

During the formation of bioabsorbable polymers, some monomeric and/or dimeric moieties fail to polymerize and are formed in and/or deposited on the polymeric product. The monomer, dimer and other byproducts of the reaction process may have a detrimental effect on products made from bioabsorbable polymers, i.e., certain of these moieties weaken the polymeric products and interfere with their absorption properties. Such moieties are vaporizable and may be removed by application of heat. For example, U.S. Pat. Nos. 3,626,948 and 3,772,420 are directed to bioabsorbable sutures and a method of removing vaporizable impurities from such sutures by placing the sutures in an airtight chamber and applying heat and vacuum. The impurities vaporize and diffuse to a cooled wall portion of the chamber and condense thereon. The devolatized suture materials can then be dyed, coated, needled, sterilized and packaged.

Another method of removing vaporizable impurities from polymeric products involves placing a polymeric product in a vacuum chamber having heated walls. An inert gas, such as nitrogen, is heated and introduced into the chamber from a single point source. The nitrogen acts as a carrier for the vaporized impurities which, along with the gas, is transported from the chamber.

The above-described processes for removing impurities have certain shortfalls which can lead to uneven heating of the polymeric product and prolongation of the removal process. The dynamics of heating chambers and various convection currents created therein result in uneven distribution of heat. The process disclosed in U.S. Pat. Nos. 3,626,948 and 3,772,420 involves heating a spool of suture material from a cavity within the spool. Uneven heating may result from a heat differential formed between the innermost and outermost portions of the spool.

In the above-described process involving nitrogen, and in accordance with the ideal gas laws, gas expands out of the single point source and cools. Such gas circulates unevenly around the chamber because gas located closer to the heated walls is kept or made hotter than the cooled gas elsewhere in the chamber. Moreover, heat from the chamber walls is not distributed evenly around the chamber due to convection currents created by the unevenly heated and unevenly distributed gas. Consequently, polymeric products are not heated evenly and vaporizable components may not be uniformly removed. In addition, the heating process is prolonged by the need to ensure that the entire product is heated sufficiently to vaporize all vaporizable components. Thus, a typical process may take as long as 50 hours or more, i.e., a first heating stage where the relevant atmosphere is brought up to sufficient heat, a second heat soaking stage, and a third cooling stage to bring the product to room temperature.

When the polymeric products are dyed prior to heat treatment, the volatile nature of the dye causes some dye to be removed through sublimation during the heat treatment. Uneven heat and gas treatment of the products is clearly revealed by a blotchy or mottled appearance of the heated product. This happens because the dye sublimes unevenly, i.e., in areas of greater heat, more dye sublimes and a lighter appearance is created than in cooler areas where less dye sublimes.

Consequently, the need to deliver a more uniform heat treatment to polymeric products undergoing post-treatment removal of vaporizable components is clear.

OBJECTS AND SUMMARY OF THE INVENTION

It is an object of the present invention to remove undesirable vaporizable components from biomedical polymeric products.

It is another object of the present invention to provide uniform heating of biomedical polymeric products during the removal of certain vaporizable components.

It is still another object of the present invention to provide uniform distribution of heated gas around biomedical polymeric products during the removal of certain vaporizable components.

It is yet another object of the present invention to provide heat treated biomedical polymeric products having a uniform color appearance following post treatment removal of certain vaporizable components.

It is a further object of the present invention to reduce the time necessary to insure adequate removal of certain vaporizable components from biomedical polymeric products.

These and other objects of the present invention will become apparent after review of the following description.

In accordance with the present invention, heated nitrogen gas is supplied to and evenly distributed within and around a heated chamber having biomedical polymeric products contained therein. The heated gas is introduced into the chamber through omnidirectional multi-point source dispersion means. The products are rotated about an axis to further evenly distribute the heated gas over the surface of the product. The heated gas vaporizes vaporizable components and carries them to a collection area where the vaporizable components are deposited.

Application of uniform heat and uniform distribution of gas in accordance with the present invention decreases the time necessary to insure that the entire polymeric product has been exposed to sufficient heat to remove all vaporizable components. Moreover, even distribution of heat over an entire product containing a dye decreases uneven dye sublimation and thus provides a product having uniform color.

DETAILED DESCRIPTION OF THE INVENTION

The present invention is characterized by even distribution and flow of heat around polymeric products to enhance uniform vaporization of certain components of the products. An inert gas, such as nitrogen is heated and caused to flow around polymeric products, such as bioabsorbable sutures. Heat transmitted from the inert gas vaporizes certain components of the product. The inert gas acts as a carrier of the vaporized components, thus removing them from the locus of the product. Examples of other inert gases include helium, neon or other noble gases.

Figure 1:
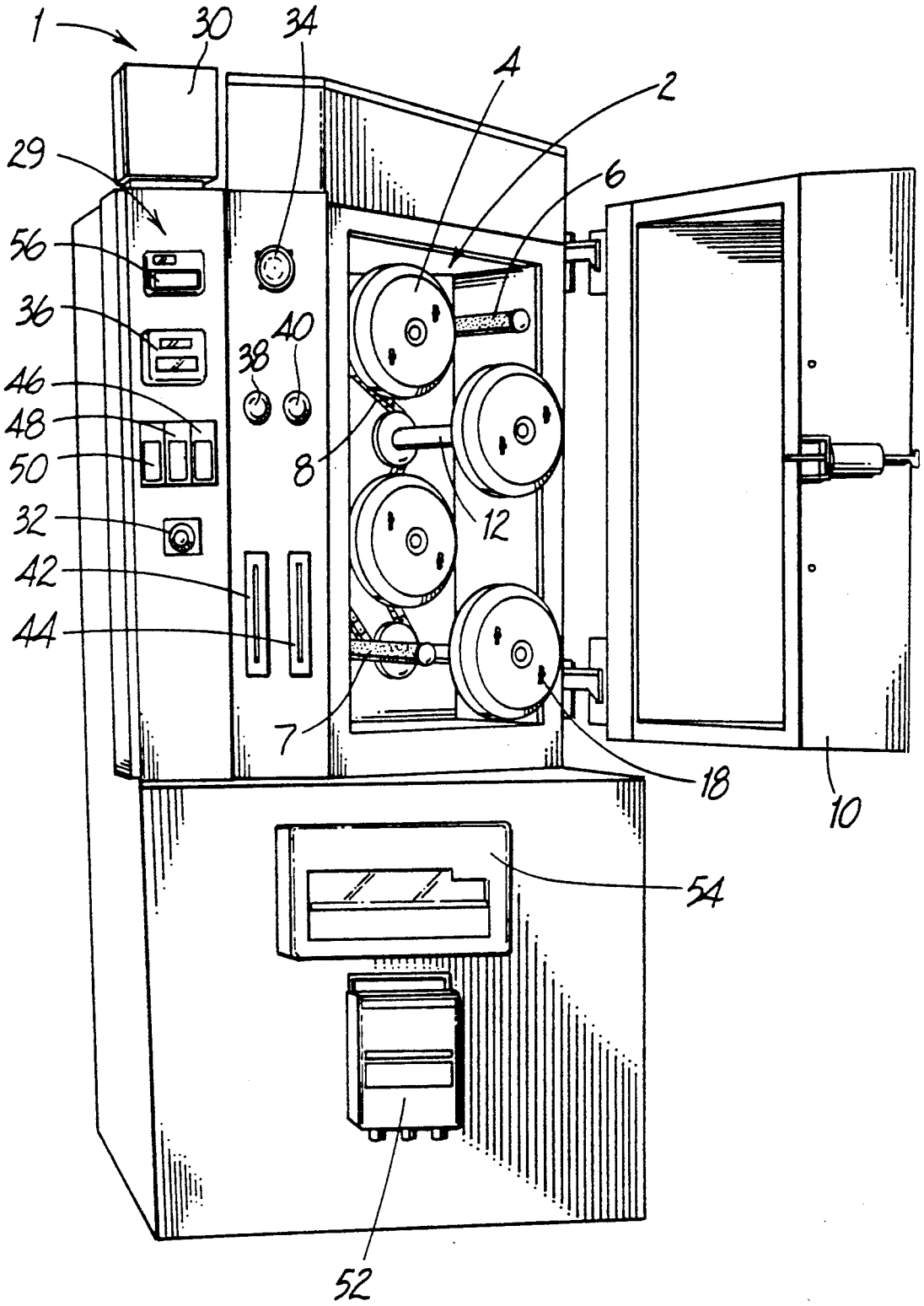
FIG. 1 is a perspective view of an apparatus for removal of vaporizable components from polymeric products according to the present invention.
Figure 2:
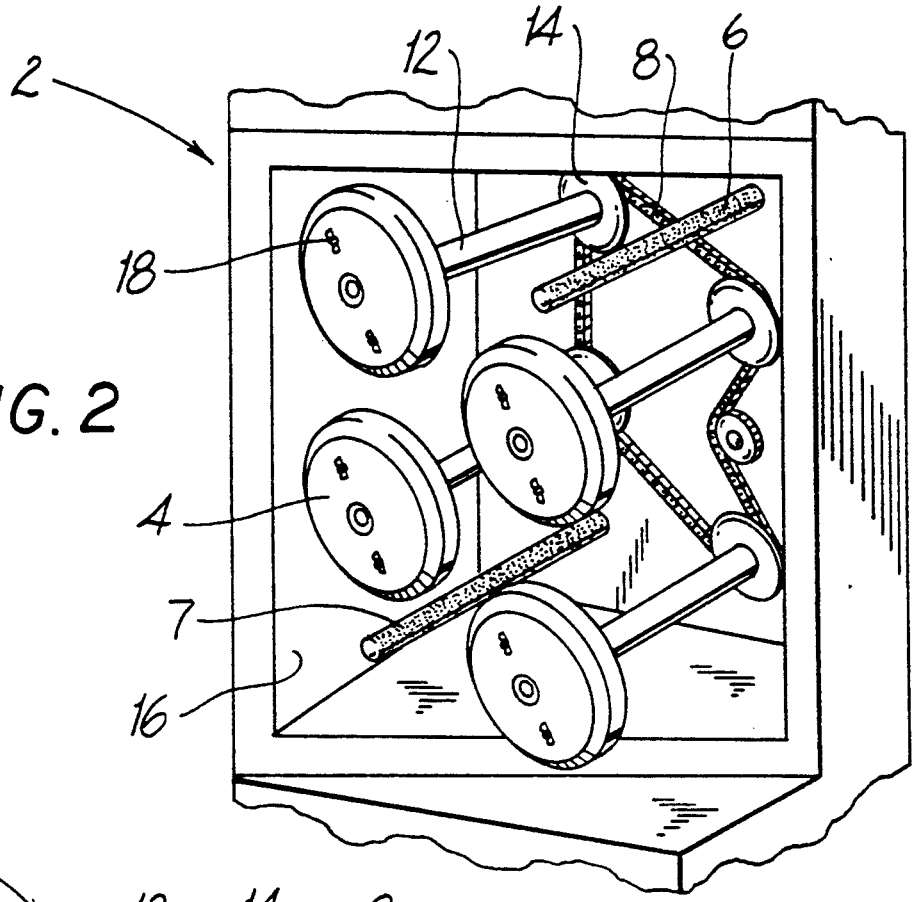
FIG. 2 is a perspective view of a chamber portion of the apparatus depicted in FIG. 1.

According to the present invention, and as is shown in FIG. 1, a preferred apparatus 1 for removing vaporizable components from biomedical products includes a chamber 2 in which biomedical products are treated. The chamber 2 is shown in perspective in FIG. 2 and includes rotatable arbors 12 which act as mounting means for the products. The arbors 12 rotate by means of the arbor drive chain 8 which is routed around all the arbors 12, thus assuring uniform rate of rotation by each arbor 12 in relation to the others. Bioabsorbable sutures are the preferred product for use in the device 1. The sutures are wrapped on one or more spools 26 (see FIG. 4) which are placed on or secured to the arbors 12. The spools 26 are secured in place by arbor caps 4 which mount to the ends of the arbors 12. Wing nuts 18 or any other appropriate securing means may be used to mount the arbor caps 4 to the arbor 12. Indeed, any means known to those with skill in the art are appropriate for causing rotation of the polymeric product contained within the chamber. For example, in this case, rotation of the arbors 12 causes rotation of the spools 26. Rotation of the product helps ensure that all points on the polymeric product receive the same distribution of heat and gas.

Figure 3:
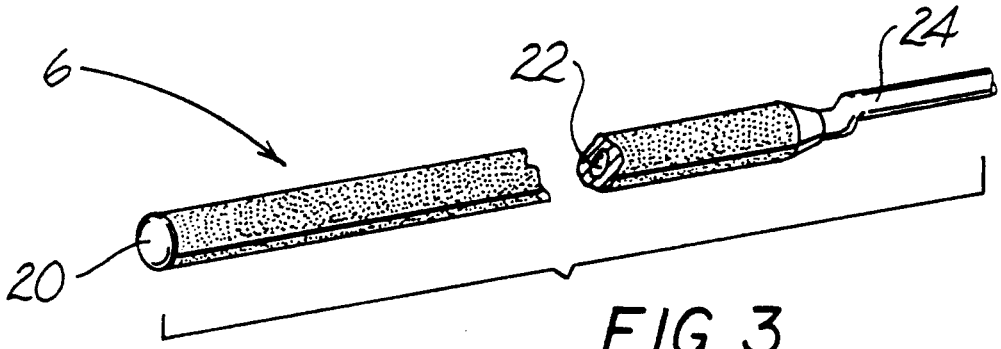
FIG. 3. is a perspective view in partial cut-away of an omnidirectional multi-point source gas dispersion means in accordance with the present invention.

Heated inert gas is caused to flow omnidirectionally into the chamber 2 via multi-point source gas dispersion means. FIGS. 1 through 4 illustrate upper multi-point gas dispersion means 6 and lower multi-point gas dispersion means 7 which are located in close proximity to the arbors 12. The arbors are preferably equidistant from each of the closest respective gas dispersion means. A preferred multi-point gas dispersion means is illustrated in FIG. 3 and includes a hollow body foraminous and/or porous rod 20 which distributes the inert gas into the chamber 2. The rod 20 has a length which is approximately the same length as the arbors 12. The inert gas is fed into the rod 20 through a gas inlet 24. The gas flows into the hollow core 22 of the rod 20 and through the pores of the foraminous matrix and into the chamber 2. The foraminous structure of the rod 20 permits 360° dispersion of gas around the rod 20. The rod 20 may be constructed of sintered metal, ceramics or any other known porous material through which a gas may flow. The gas dispersing foraminous rods 20 ensure uniform distribution of heated gas along the length of objects mounted to the mounting means.

Figure 6:
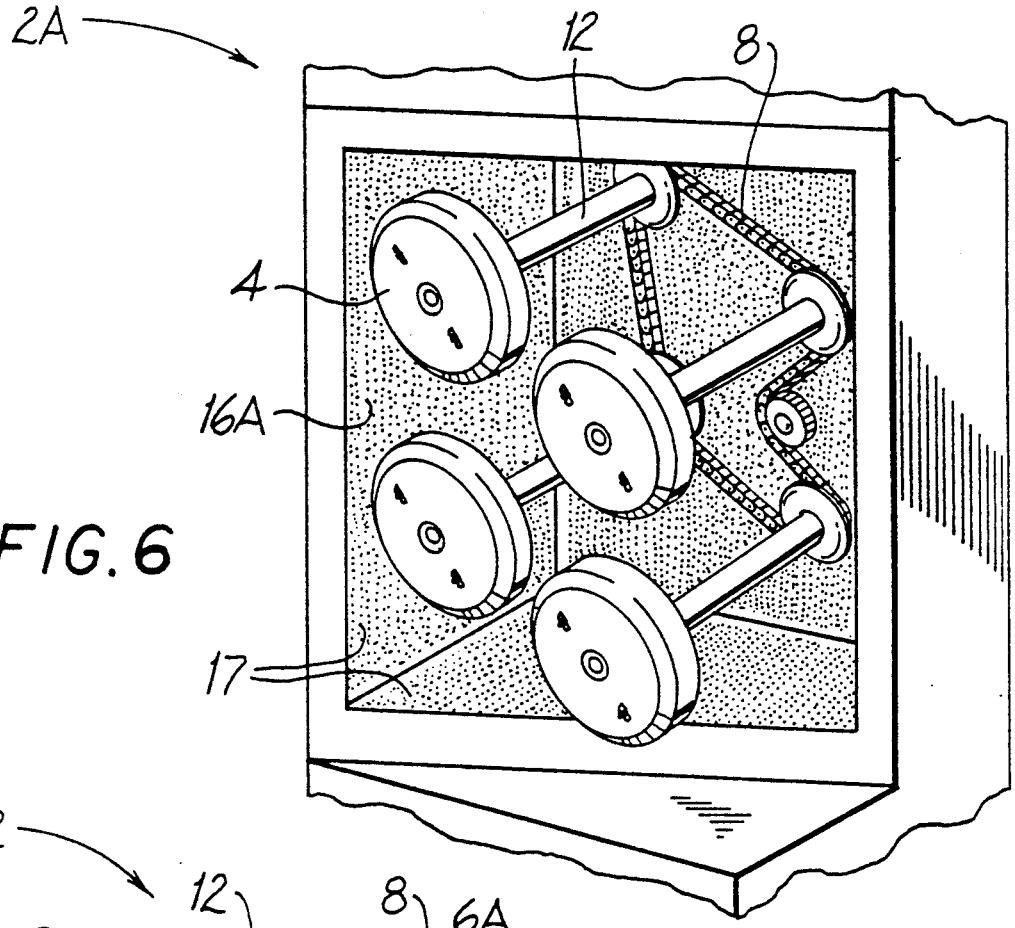
FIG. 6 is a perspective view of another embodiment of a chamber portion of the apparatus according to the present invention.

An alternative embodiment includes the location of an omnidirectional multi-point gas dispersion means in the walls 16A of the chamber 2A. FIG. 6 illustrates walls 16A having a multiplicity of holes or pores 17 disposed therein. Heated inert gas is supplied to the interior of each wall 16A and is forced through the pores 17 and into the chamber 2A. The distribution of pores 17 throughout the surface of the walls 16A of the chamber 2A allows the gas, and consequently, heat to enter and diffuse uniformly to all points within the chamber 2A.

Figure 8:
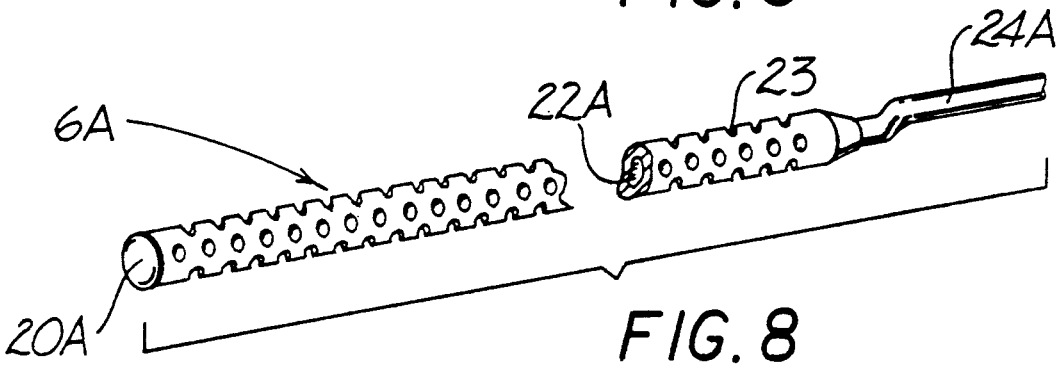
FIG. 8 is a perspective view in partial cut-away of an omnidirectional multi-point source gas dispersion means in accordance with the present invention.
Figure 7:
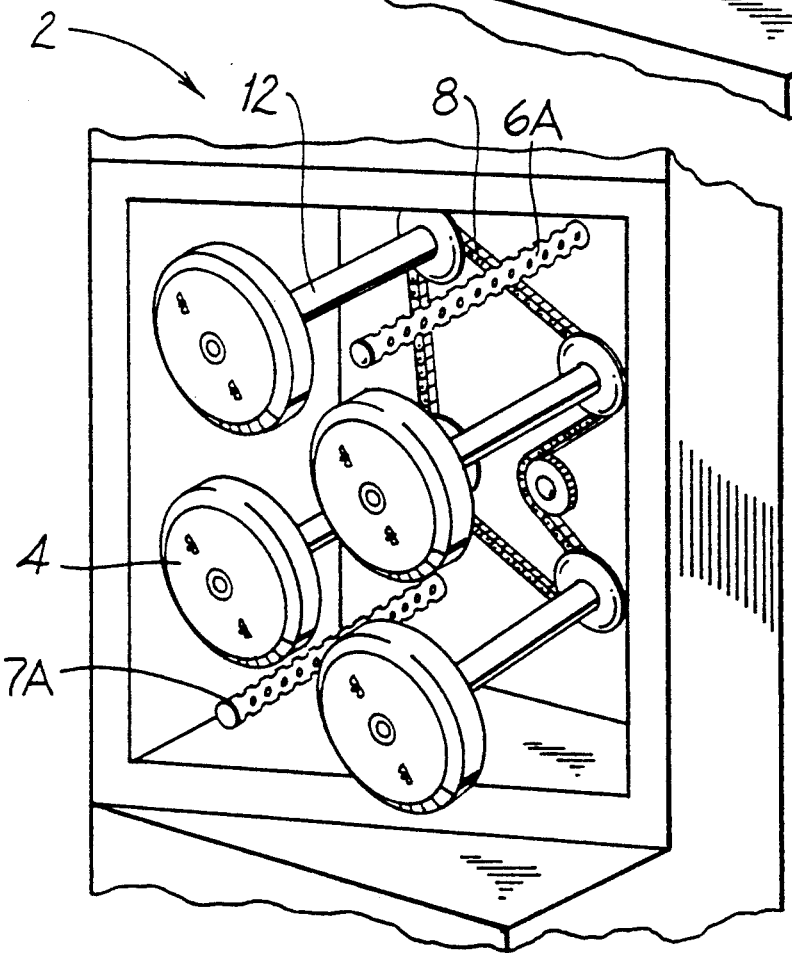
FIG. 7 is a perspective view of another embodiment of a chamber portion of the apparatus according to the present invention.

FIGS. 7 and 8 depict a chamber 2 and another alternative omnidirectional multi-point gas dispersion means. A hollow body rod 20A having circular outlets or holes 23 distributes inert gas into the chamber 2. The heated inert gas is fed into the rod 20A through an inlet 24A. The gas is forced into a hollow core 22A and then through holes 23 and into the chamber 2. An upper omnidirectional multi-point gas dispersion means 6A disperses gas to the upper portion of the chamber 2 and a lower omnidirectional multi-point gas dispersion means 7A disperses gas to the lower portion of the chamber 2.

One or more chamber walls 16 have heating and cooling elements contained therein. When the door 10 of the chamber 2 is closed, an air-tight seal is formed, e.g., by vacuum within chamber 2 causing outside air pressure to seal the door 10, and temperature and pressure may be regulated within the chamber 2. For purposes of the present invention, when the door 10 is closed, it also constitutes a wall and can contain heating and cooling elements. In a preferred embodiment, the upper gas dispersion means 6 and lower gas dispersion means 7 have independent heat sources which can be regulated independently of each other to provide uniform gas heat within the chamber 2. Likewise, the rear wall of the chamber 2 may be heated independently of the other walls. Each independent heat source is monitored by thermocouple sensors and information gained thereby is readable by the operator of the device 1. An optical scanner 12 reads the temperature at the surface of the polymeric material and indicates precisely whether the system parameters are being properly effected.

An instrument panel 29 contains controls and information display devices. A digital torr meter 56 indicates pressure within the chamber and is suited for accurately indicating low pressure. An analog mechanical pressure gauge 34 is well suited for accurately indicating higher pressures within the chamber. The temperature of the chamber walls 16 is indicated and controlled by the wall temperature programmer control 36 which can be programmed to gradually increase or decrease temperature over set periods of time. The temperature of gas flowing into the upper gas dispersion means 6 is controlled by the upper gas dispersion means temperature control 48 and the temperature of the lower gas dispersion means 7 is controlled by the lower gas dispersion means temperature control 46. The rate of flow of gas in cubic feet per minute (CFM) through the upper gas dispersion means 6 is controlled by an upper flow regulator 42. The rate of flow of gas (CFM) through the lower gas dispersion means is controlled by a lower flow regulator 44. The temperature readings made by the optical scanner 62 are displayed on an optical scanner temperature display 52.

A strip chart 54 displays temperature and pressure information versus time. Such information includes optical scanner temperature, chamber pressure, side wall temperature, back wall temperature, temperature of gas entering the upper gas dispersion means, temperature of gas entering the lower dispersion means, temperature of the upper gas dispersion means, temperature of the lower gas dispersion means, temperature of the heating element for gas flowing through the upper dispersion means and temperature of the heating element for gas flowing through the lower dispersion means. Precise monitoring of these parameters allows the operator of the apparatus 1 to carefully regulate the process of removing vaporizable components from polymeric products.

A gas outlet pipe 64 is attached to chamber 2 or 2A and routes any gas leaving the chamber to a collection area. The collection area includes a first trap 66 and a second trap 70. The traps are cooled so as to cool the gas flowing through the traps. Thus, heated gas carrying vaporized elements flows through the traps and the vaporized components condense and collect in the traps. A gas outlet pipe heating element 74, also known as a heat trace, heats the gas outlet pipe 64 and maintains the temperature of the gas exiting the chamber to prevent premature condensation of the vaporized components on the interior of the gas outlet pipe 64. After leaving the traps, the gas flows through a final outlet 72 and is vented to the outside atmosphere.

The apparatus according to the present invention allows uniform and consistent application of heat to polymeric products or materials contained in the chamber 2. As is described below, the time necessary for removing vaporizable components from polymeric materials such as bioabsorbable sutures is significantly decreased over existing methods.

Figure 4:
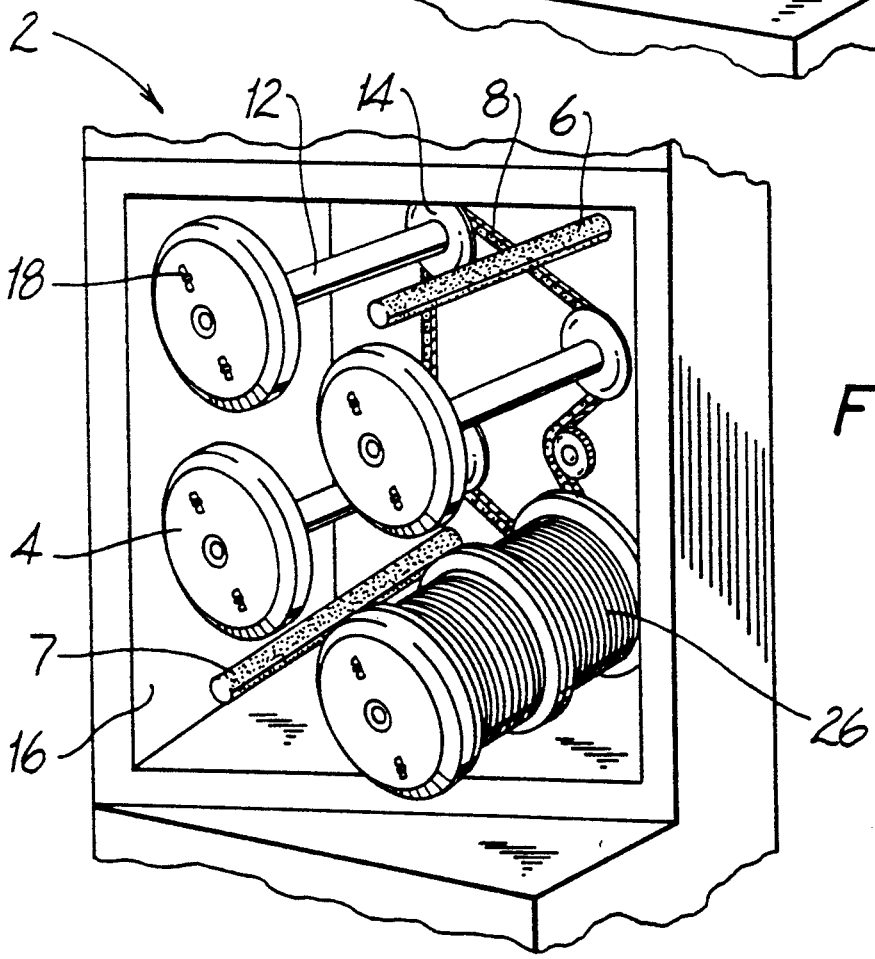
FIG. 4 is a perspective view of the chamber shown in FIG. 2, further depicting placement of spools containing surgical sutures mounted within the chamber.

The process of removing vaporizable components is preferred for use on bioabsorbable polymeric suture material, but is adaptable for polymeric drug delivery devices, textiles and other polymeric devices having vaporizable components. For example and in accordance with the present invention, bioabsorbable polymeric sutures are wrapped around aluminum spools 26. Aluminum is a preferred metal because it is lightweight and has good heat transmitting characteristics. The suture material is wrapped around the spool to a preferable depth of from about = to about ¼ inch. The preferred spool has an interior diameter of about 6 inches. The suture spools 26 are inserted over the arbors 12 as can be seen in FIG. 4. The arbor caps 4 hold the suture spools 26 in place on the arbors 12.

The door 10 of the chamber is closed by the operator and sealed shut by a vacuum applied by evacuating to about 500 millitorr vacuum. The interior of the chamber walls 16 is flushed with compressed air to remove water which was used as a cooling element in a previous cycle. Room temperature nitrogen gas is infused into the chamber 2 preferably at a pressure above the chamber 2 pressure, e.g., from about 5 to about 200 pounds per square inch (PSI), but most preferably about 40 PSI, through the omnidirectional gas dispersion means until pressure stabilizes preferably at about 50 to about 110 torr, but most preferably at about 80 torr. In accordance with the present invention, it should be noted that the pressure inside the chamber could range from a substantially absolute vacuum to any pressure above. The heat of the gas and chamber 2 is increased over a period preferably of from about instantaneously to about 15 hours or more, but most preferably about 10 to 12 hours. The temperature may be increased linearly from room temperature to about 100° C. to about 150° C. in that time period or it may be gradationally increased. Any water contained in or on the product and/or chamber 2 is removed during the increase in temperature. From the time the chamber 2 is sealed, until the spools 26 are removed, the arbors 12 turn uniformly at a rate of about 1 or more rotations per hour, but preferably about 3 rotations per hour.

In the next stage, which has a duration of from about 0.01 to about 20 or more hours, but preferably about 10 hours, the spools 26 containing sutures are soaked and rotated in the heated nitrogen bath at preferably about 100° C. to about 150° C., but most preferably 130° C. The vaporizable components are carried and removed by the nitrogen gas through the gas pipe outlet 64 to condense in the traps 66, 70.

In the final stage, preferably lasting from about 0.01 hours to 15 hours or more, but most preferably 9 hours, the chamber 2 is cooled until a uniform product temperature of about 50° C. or less, but preferably about 35° C. is reached. Cooling is accomplished by running cold water through the walls 16 of the chamber 2 from a water inlet pipe (not shown). The water may then be left in the walls 16 until the start of the next cycle whereupon the water is flushed out by compressed air.

Figure 9:
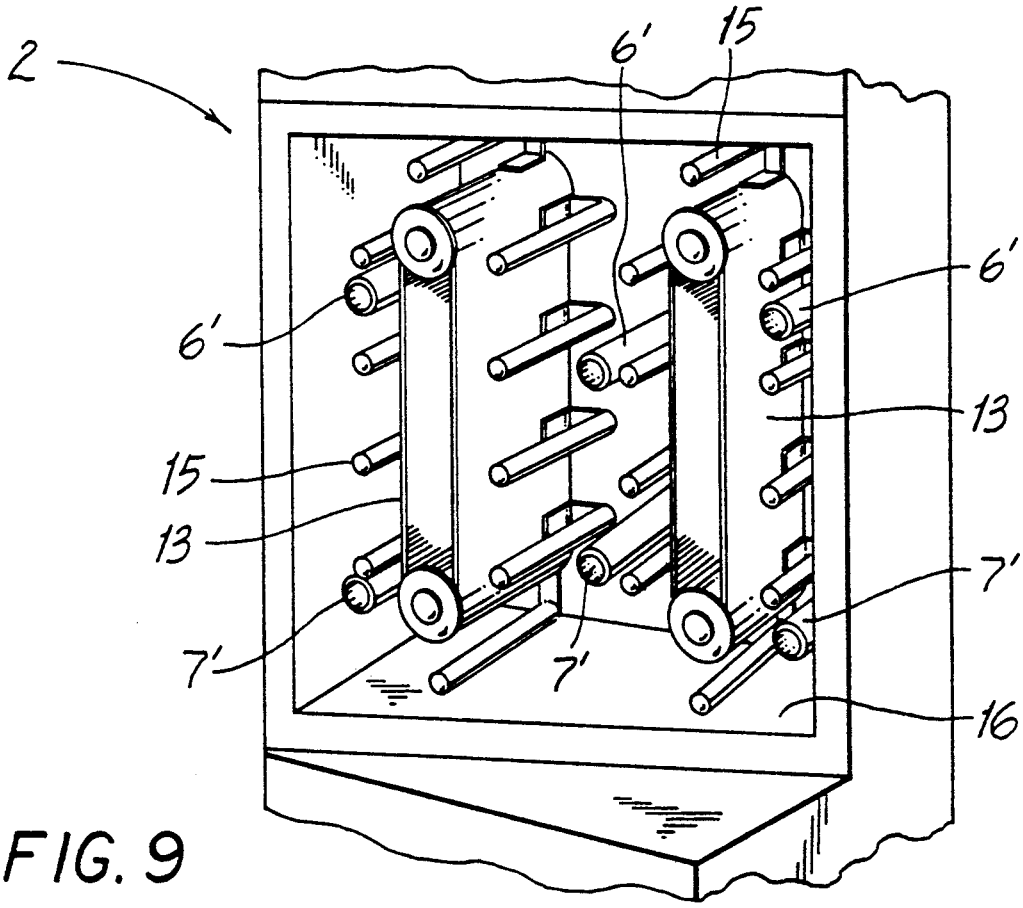
FIG. 9 is a perspective view of another embodiment of a chamber portion of the apparatus according to the present invention.
Figure 5:
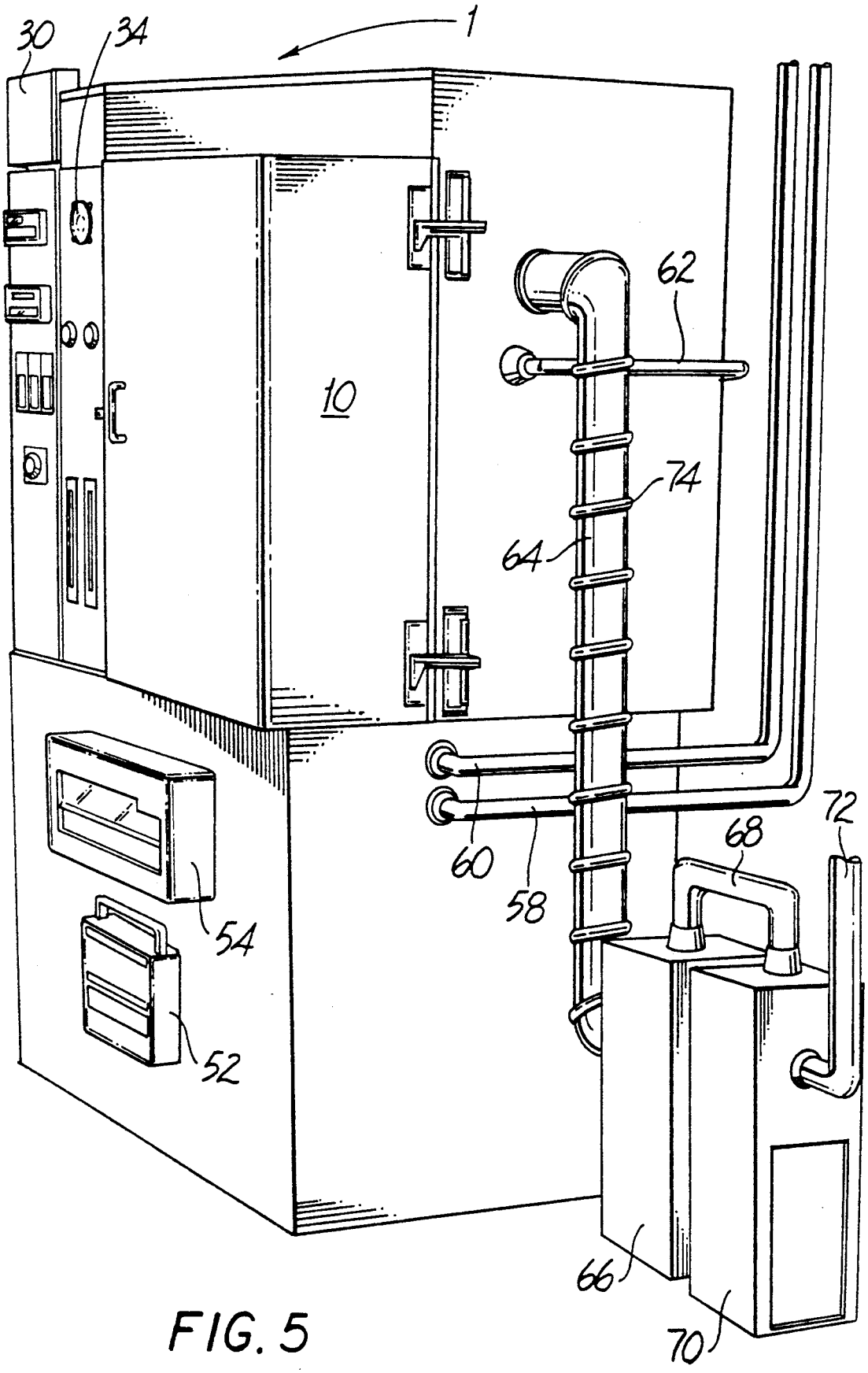
FIG. 5 is a perspective view of the apparatus for removal of vaporizable components from polymeric products according to the present invention, further depicting a collecting means for such components.

The examples and embodiments depicted in this specification are not intended to be limitations of the inventive concept described herein. For example, polymeric products may be suspended in the chamber in any fashion, e.g., hung on rotating hooks or attached to a conveyor belt apparatus and transported around the chamber during treatment. FIG. 9 depicts a conveyor belt apparatus 13 and product mounting means 15 disposed within the chamber 2. The gas dispersion means includes three upper gas dispersion means 6' and three lower gas dispersion means 7'. Moreover, the time periods and pressures given as examples herein may be adjusted to achieve varying degrees of vaporization. Furthermore, certain of the above-described stages can be combined, truncated or even eliminated. For example, the first stage, during which the temperature is increased, may also serve as the soaking stage and may be immediately followed by the final cooling stage. Accordingly, one with skill in the art may make modifications in the method and apparatus which are intended to be covered by the following claims.

What is claimed is

1. An apparatus for removing vaporizable components of polymeric material by a gas carrier, said apparatus comprising:

a chamber;

support means for supporting polymeric materials within said chamber;

multi-point gas dispersion means in communication with said chamber;

a heating element for heating gas that flows through said multi-point gas dispersion means;

means for establishing and maintaining pressure in said chamber below outside atmospheric pressure; and means for evacuating said chamber.

2. An apparatus according to claim 1 further comprising collection means for collecting vaporizable components that are vaporized by heat from the gas.

3. An apparatus according to claim 1 wherein the polymeric material is rotated on said support means by rotating means.

4. An apparatus according to claim 1 wherein the support means is an arbor.

5. An apparatus according to claim 1 wherein said multi-point gas dispersion means is omnidirectional.

6. An apparatus according to claim 5 wherein said multi-point gas dispersion means comprises one or more hollow core porous rods.

7. An apparatus according to claim 5 wherein said omnidirectional multi-point gas dispersion means comprises one or more hollow core foraminous rods.

8. An apparatus according to claim 1 wherein said gas is an inert gas.

9. An apparatus according to claim 8 wherein said inert gas is nitrogen.

10. An apparatus according to claim 2 wherein the collection means comprises a trap.

11. An apparatus according to claim 10 wherein the trap is comprised of walls which are cooler than the gas containing the vaporized components.

12. An apparatus according to claim 1 wherein one or more walls of said chamber contain one or more heating elements.

13. An apparatus according to claim 1 wherein one or more walls of said chamber contain one or more cooling elements.

14. An apparatus according to claim 3 further comprising sensor means for monitoring temperature and pressure within said chamber.

15. An apparatus according to claim 3 wherein said support means are rotated by a drive means.

16. A method for removing impurities from polymeric materials comprising:

(i) enclosing polymeric material in a chamber;

(ii) reducing pressure in said chamber to below outside atmospheric pressure;

(iii) heating a gas;

(iv) delivering and dispersing the heated gas in the chamber via an omnidirectional multi-point source gas dispersion means while maintaining said pressure below outside atmospheric pressure;

(v) contacting the polymeric material with the heated gas;

(vi) vaporizing vaporizable components contained by the polymeric material; and (vii) creating a continuous flow of a gas by transporting the vaporized components out of the chamber while delivering and dispersing the heated gas in the chamber per step (iv) above.

17. A method according to claim 16 wherein the polymeric materials are rotated about an axis in said chamber.

18. A method according to claim 17 wherein the polymeric material is rotated at about 1 or more rotations per hour.

19. A method according to claim 16 wherein the gas is an inert gas.

20. A method according to claim 19 wherein the inert gas is nitrogen.

21. A method according to claim 16 wherein the gas is heated to from about 100° C. to about 150° C.

22. A method according to claim 21 wherein the gas is heated to about 130° C.

23. A method according to claim 16 wherein one or more walls of said chamber are heated to a temperature of from about 100° C. to about 150° C.

24. A method according to claim 23 wherein one or more of said walls are heated to about 130° C.

25. A method according to claim 16 wherein the pressure is maintained at a dynamic equilibrium of from about 50 to about 110 torr.

26. A method according to claim 25 wherein the pressure is maintained at a dynamic equilibrium of about 80 torr.

27. A method according to claim 16 wherein the temperature of the chamber is increased from room temperature to about 130° C. over a period of time ranging from about 0.01 hours to about 15 hours.

28. A method according to claim 27 wherein the period of time for increasing temperature is about 11 hours.

29. A method according to claim 16 wherein the polymeric material is soaked in nitrogen gas heated to about 130° C. for from about 0.01 hours to about 20 hours.

30. A method according to claim 29 wherein the polymeric material is soaked in nitrogen for about 10 hours.

31. A method according to claim 29 wherein a period of cooling from about 0.01 hours to about 15 hours is applied to the polymeric material after soaking in nitrogen.

32. A method according to claim 31 wherein the period of cooling is about 9 hours.

33. A method according to claim 16 further comprising condensing the vaporized components.

34. A method for removing vaporizable impurities from bioabsorbable polymeric materials comprising:

(i) providing a bioabsorbable polymeric material;

(ii) enclosing said bioabsorbable polymeric material in a chamber;

(iii) causing gas to flow into the chamber through multi-port source gas dispersion means;

(iv) contacting said bioabsorbable polymeric material with said gas;

(v) vaporizing vaporizable components contained by said bioabsorbable polymeric material; and (vi) transporting said vaporizable components out of the chamber.

35. A method for removing vaporizable impurities from bioabsorbable polymeric materials comprising:

(i) providing at least one spool;

(ii) disposing a bioabsorbable polymeric material on said at least one spool;

(iii) providing a chamber having at least one rotatable support member and at least one multiport source gas dispersion means;

(iv) placing said at least one spool having said bioabsorbable polymeric material disposed thereon on said at least one rotatable support member in said chamber;

(v) causing gas to flow from said at least one multiport source gas dispersion means;

(vi) contacting said bioabsorbable polymeric material with said gas;

(vii) vaporizing vaporizable components contained by said bioabsorbable polymeric material; and (viii) transporting said vaporized components out of the chamber.

36. A method according to claim 35 wherein said bioabsorbable polymeric material is a suture.

37. A method according to claim 35 wherein said gas is heated.

38. A method according to claim 35 wherein said multiport source gas dispersion means comprises at least one hollow core foraminous rod.

39. A method according to claim 35 further comprising maintaining pressure in said chamber below outside atmospheric pressure.

* * * * *